US006563371B2

(12) United States Patent
Buckley, III et al.

(10) Patent No.: US 6,563,371 B2
(45) Date of Patent: May 13, 2003

(54) CURRENT BANDGAP VOLTAGE REFERENCE CIRCUITS AND RELATED METHODS

(75) Inventors: Frederick Buckley, III, San Jose, CA (US); Paul D. Hildebrant, Banks, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/939,423

(22) Filed: Aug. 24, 2001

(65) Prior Publication Data

US 2003/0038672 A1 Feb. 27, 2003

(51) Int. Cl.[7] ..... G05F 1/10
(52) U.S. Cl. ..... 327/539; 327/513
(58) Field of Search ..... 327/538, 539, 327/540, 541, 543, 512, 513

(56) References Cited

U.S. PATENT DOCUMENTS 5,430,395 A * 7/1995 Ichimaru ..... 327/312
5,796,244 A * 8/1998 Chen et al. ..... 323/313
6,310,510 B1 * 10/2001 Goldman et al. ..... 327/538

OTHER PUBLICATIONS

Analysis and Design of Analog Integrated Circuits, Chapter 4, Transistor Current Sources and Active Loads, 1977.

* cited by examiner

*Primary Examiner*—Kenneth B. Wells
(74) *Attorney, Agent, or Firm*—Blakley, Sokoloff, Taylor & Zafman LLP

(57) ABSTRACT

A bandgap voltage reference circuit and related method characterized in having a first current source for generating a first current having a positive temperature coefficient, a second current source for generating a second current having a negative temperature coefficient, and a resistive element to receive both the first and second current to develop a reference voltage. By configuring the circuit such that the magnitudes of the positive and negative temperature coefficients are substantially the same, the reference voltage becomes substantially invariant with changes in temperature. Another circuit is provided in conjunction with the voltage reference circuit to substantially equalize the drain-to-source voltage of the transistors used in the voltage reference circuit.

19 Claims, 3 Drawing Sheets

CURRENT BANDGAP VOLTAGE REFERENCE CIRCUITS AND RELATED METHODS

FIELD

This invention relates generally to bandgap voltage reference circuits, and in particular, to bandgap voltage reference circuits and related methods that add two currents having respectively opposite polarity temperature coefficients to generate a substantially temperature-invariant reference voltage.

GENERAL BACKGROUND

A bandgap voltage reference circuit is typically used to provide a voltage reference for other circuits to use in performing their intended operations. Generally, it is desired that the reference voltage generated by a bandgap circuit is substantially invariant. This is so even if there are substantial variations in the environment temperature. Thus, many, if not all, bandgap circuits incorporate temperature compensating circuitry in order to generate a substantially temperature-invariant reference voltage.

FIG. 1 illustrates a schematic diagram of a prior art bandgap voltage reference circuit 100. The bandgap circuit 100 consists of PMOS transistors Q11, Q12, and Q13, and NMOS transistors Q14 and Q15 configured as current mirrors to generate substantially equal currents I11, I12, and I13. The bandgap circuit 100 further consists of resistor R11 and diode D11 coupled in series with PMOS transistor Q11 and NMOS transistor Q14 to receive current I11, a diode D12 coupled in series with PMOS transistor Q12 and NMOS transistor Q15 to receive current I12, and resistor R12 and diode D13 coupled in series with PMOS transistor Q13 to receive current I13. The diodes D11, D12, and D13 are forward biased with their cathode coupled to ground terminal. The output reference voltage of the bandgap circuit 100 is generated at the node between the PMOS transistor Q13 and resistor R12.

The temperature compensation of the output reference voltage of the bandgap circuit 100 operates as follows. The current I12 generates a voltage V13 across the diode D12. The voltage V13 has a negative temperature coefficient −TαV13. The current I11 generates a voltage V12 across the diode D11. The voltage V12 also has a negative temperature coefficient −TαV12 that is more negative than the temperature coefficient −Tα13 of voltage V13 (i.e. −TαV12<−TαV13). The current mirror causes the voltage V11 on the node between transistor Q14 and resistor R11 to be substantially equal to the voltage V13. Thus, the voltage VR11 across the resistor R11 (VR11=V11−V12) has a positive temperature coefficient +TαR11 due to −TαV12 being more negative than −TαV13. Since the current I11 through resistor R11 is proportional to the voltage VR11 across the resistor R11, the current I11 likewise has a positive temperature coefficient +TαI11.

The current mirror causes the current I13 to be substantially equal to the current I11. Therefore, the current I13 also has a positive temperature coefficient +TαI13. It follows then that the voltage VR12 across resistor R12 has a positive temperature coefficient +TαV12 since VR12 is proportional to the current I13. Additionally, the current I13 generates a voltage V14 across the diode D13 that has a negative temperature coefficient −TαV14. The reference voltage VREF is the sum of voltages VR12 and V14, both of which have opposite polarity temperature coefficients. Thus, by proper design of the bandgap circuit 100, the reference voltage VREF can be made substantially temperature invariant across a particular temperature range.

FIG. 2 illustrates a schematic diagram of another prior art bandgap circuit 200. The bandgap circuit 200 operates similar to bandgap circuit 100. Briefly, the voltage V22 across the diode D22 has a negative temperature coefficient −TαV22 and the voltage V21 across the diode D21 also has a negative temperature coefficient −TαV21 that is more negative than −TαV22. The operational amplifier U21 causes the voltage V23 at the positive terminal of the operational amplifier U21 to be substantially the same as voltage V22 across diode D22, which also has a similar negative temperature coefficient −TαV23. Since −TαV21 is more negative than −TαV23, the voltage VR21 across resistor R21 has a positive temperature coefficient +TαVR21, and accordingly the current I21 through resistor R21 also has a positive temperature coefficient +TαI21. The current I21, as well as current I22 through resistor R22, are derived from the current I20 through PMOS transistor Q21. Thus, they all have a positive temperature coefficient. The reference voltage VREF is thus the addition of the voltage V22 and the voltage drop across resistor R22, both of which have opposite polarity temperature coefficients which can be made to cancel out.

A drawback of the prior art bandgap circuits 100 and 200 stems from the reference voltage VREF being a combination of two voltage drops in series. In bandgap circuit 100, the reference voltage VREF is a combination of V14 across the diode D13 and VR14 across the resistor R12. In bandgap circuit 200, the reference voltage VREF is a combination of V22 across the diode D22 and VR22 across the resistor R22. Because of this, the power supply voltage VDD needs enough headroom to accommodate both voltages that form the reference voltage VREF in addition to the source-drain voltages of transistor Q13 or Q21. The reference voltage VREF typically requires about 1.2V and the source-drain voltage of transistor Q13 or Q21 requires at least 0.2V. Thus, the minimum power supply voltage VDD required is about 1.4V, which makes the prior bandgap circuits 100 and 200 not compatible with emerging technologies that use VDD at significantly lower voltage than 1.4V, such as 1V.

DETAILED DESCRIPTION

Figure 1:
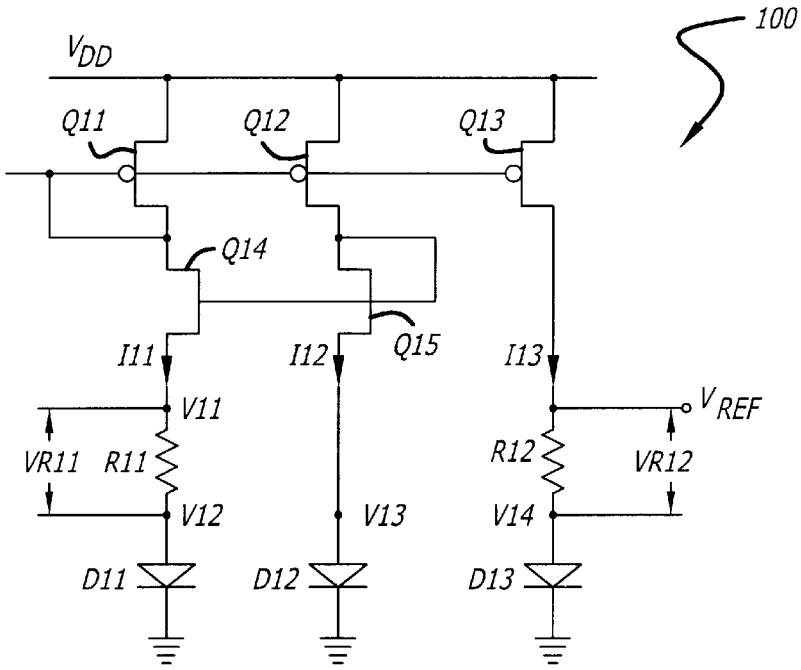
FIG. 1 (Prior Art)
FIG. 1 illustrates a schematic diagram of a prior art bandgap voltage reference circuit.
Figure 2:
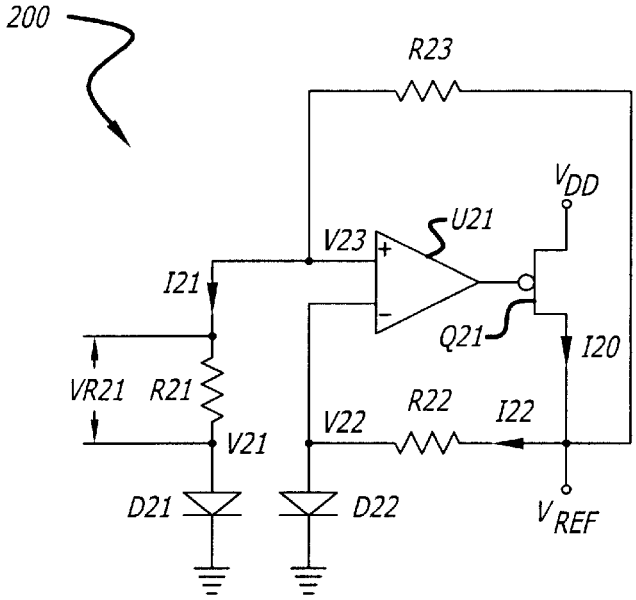
FIG. 2 (Prior Art)
FIG. 2 illustrates a schematic diagram of another prior art bandgap voltage reference circuit.
Figure 3:
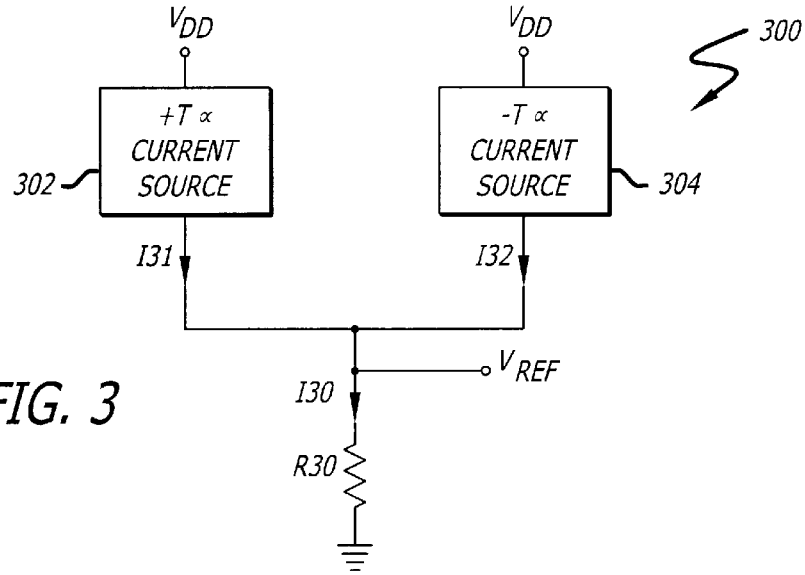
FIG. 3 illustrates a schematic diagram of an exemplary bandgap voltage reference circuit in accordance with an embodiment of the invention.

FIG. 3 illustrates a schematic diagram of an exemplary bandgap voltage reference circuit 300 in accordance with an embodiment of the invention. The bandgap circuit 300 comprises a +Tα current source 302 that generates a current I31 that has a positive temperature coefficient +TαI31, a −Tα current source 304 that generates a current I32 that has a negative temperature coefficient −TαI32, and a resistor R30 having one end coupled to the outputs of the current sources 302 and 304 and the other end coupled to ground. The currents I31 and I32 combine to form current I30 flowing through resistor R30 to generate the reference voltage VREF for the bandgap circuit 300. Since reference voltage VREF varies proportional to the current I30, which is formed of currents I31 and I32 having opposite temperature coefficients +TαI31 and −TαI32, the reference voltage VREF can be made to be substantially temperature invariant by proper design of the +Tα current source 302 and the −Tα current source 304.

Figure 4:
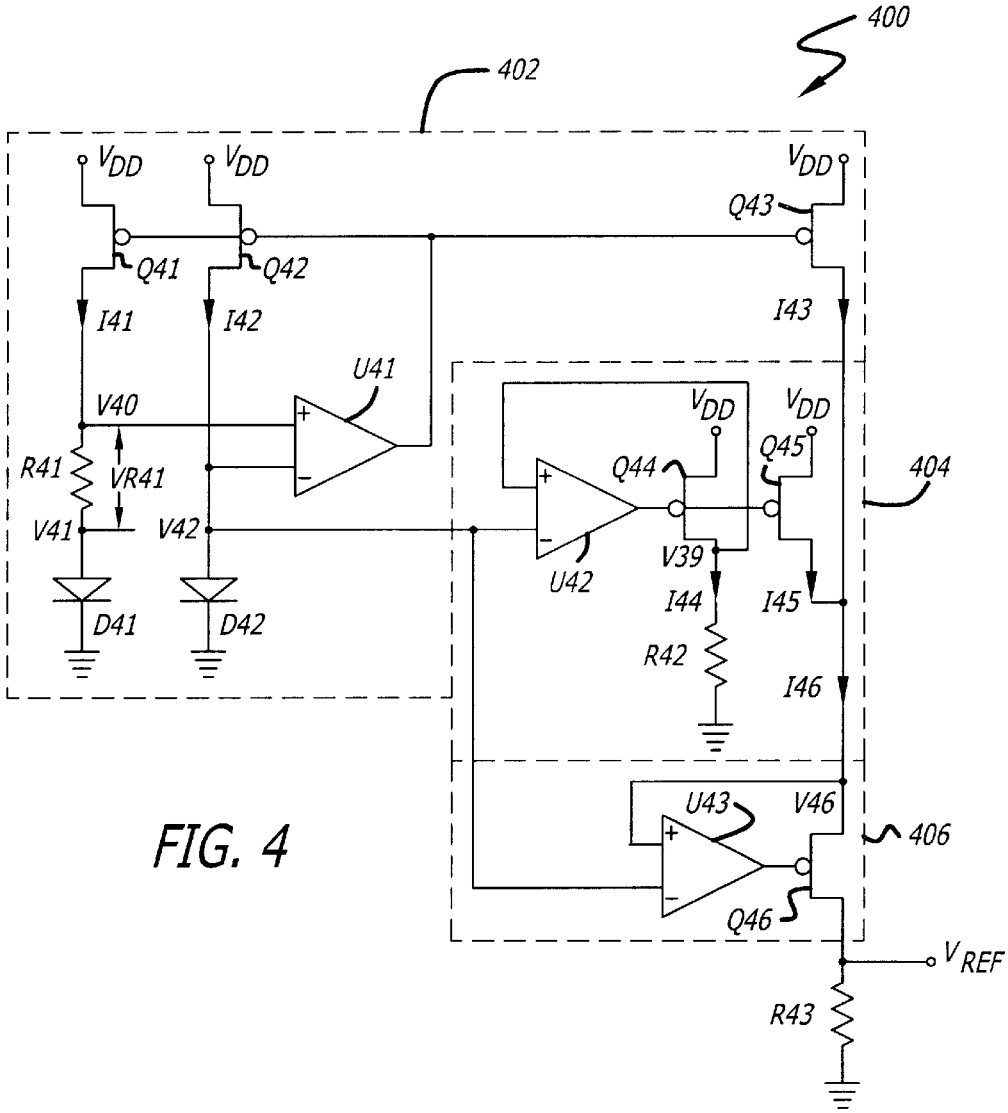
FIG. 4 illustrates a schematic diagram of an exemplary bandgap voltage reference circuit in accordance with another embodiment of the invention.

FIG. 4 illustrates a schematic diagram of an exemplary bandgap voltage reference circuit 400 in accordance with a more specific embodiment of the invention. The bandgap circuit 400 comprises a +Tα current source section 402, a −Tα current source section 404, an optional transistor source-to-drain voltage matching circuit 406, and a resistor R43 to generate the reference voltage VREF across thereof The +Tα current source section 402, in turn, comprises PMOS transistors Q41, Q42, Q43, operational amplifier U41, resistor R41, and diodes D41 and D42. The −Tα current source section 404, in turn, comprises an operational amplifier U42, PMOS transistors Q44 and Q45, and resistor R42. And, the optional transistor source-to-drain voltage matching circuit 406, in turn, comprises an operational amplifier U43 and PMOS transistor Q46.

The +Tα current source section 402 operates as follows. The PMOS transistors Q41, Q42, and Q43 are configured as a current mirror to generate substantially equal currents I41, I42, and I43. More specifically, the PMOS transistors Q41, Q42, and Q43 have sources coupled to the power supply rail VDD and gates coupled together. The diode D42 is configured to receive the current I42 in a forward bias manner to develop across it a voltage V42 that has a negative temperature coefficient −TαV42. The diode D41 is configured to receive the current I41 in a forward bias manner to develop across it a voltage V41 that has a negative temperature coefficient −TαV41 that is more negative than −TαV42.

The operational amplifier U41, having the voltage V42 applied to its negative terminal, generates a gate voltage for the PMOS transistors Q41, Q42, and Q43 that causes a voltage V40 to appear at the positive terminal of the operational amplifier U41 that is substantially the same as voltage V42, along with substantially the same temperature coefficient (−TαV40=−TαV42). Since the temperature coefficient −TαV41 of voltage V41 is more negative than the temperature coefficient −TαV40 of voltage V40, the voltage VR41 across the resistor R41 exhibits a positive temperature coefficient +TαVR41. Therefore, the current I41, being proportional to the voltage VR41, also exhibits a positive temperature coefficient +TαI41. The current mirror mirrors the current I41 to the current I43 which as a result, has a positive temperature coefficient +TαV43. The current I43 serves as the positive temperature coefficient current that forms the reference voltage VREF of the bandgap circuit 400.

The −Tα current source section 404 operates as follows. The voltage V42 is applied to the negative input of the operational amplifier U42. The operational amplifier U42 having its output drive the gate of PMOS transistor Q44 causes a voltage V39 to be generated at the positive input of the operational amplifier U42 that is substantially the same as voltage V42, along with substantially the same temperature coefficient (−TαV39=−TαV42). The positive input of the operational amplifier U42 is connected to the drain of the PMOS transistor Q44 and to resistor R42. As a result, a drain current I44 is generated that is proportional to the voltage V39. Since the voltage V39 has a negative temperature coefficient −TαV39, the current I44 also has a negative temperature coefficient −TαI44. The PMOS transistors Q44 and Q45 having their gates connected together mirror the current I44 to current I45 flowing through transistor Q45. The current I45 thus has a negative temperature coefficient −TαI45. The current I45 serves as the negative temperature coefficient current that forms the reference voltage VREF of the bandgap circuit 400.

The positive temperature coefficient current I43 and the negative temperature coefficient current I45 add to form current I46 which flows through the resistor R43 to form across it the reference voltage VREF. The reference voltage VREF can be made substantially temperature invariant by proper design of resistors R41 and R42 and diodes D41 and D42.

The optional transistor drain-to-source voltage matching circuit 406 is provided to substantially equalize the source-to-drain voltages of the transistors Q41, Q42, Q43, Q44 and Q45. The source-to-drain voltages for transistors Q41, Q42 and Q44 are already set to VDD−V42. The operational amplifier U43 is configured as a voltage follower to produce a voltage V46 (substantially equal to voltage V42) at the drains of transistors Q43 and Q45. Thus, the optional transistor source-to-drain voltage matching circuit 406 also causes the source-to-drain voltage of transistors Q43 and Q45 to be at approximately Vdd−V42. This reduces errors that would result from different voltages across the finite output resistances of transistors Q41, Q42, Q43, Q44, and Q45.

An advantage of the bandgap reference voltage circuits 300 and 400 over the prior art bandgap circuits 100 and 200 stems from the generating of the positive and negative temperature coefficient currents at different circuit sections and then combining them to form the reference voltage VREF. This uses less VDD voltage to implement, allowing VDD to be smaller so that the circuits 300 and 400 can be used on technologies requiring relatively low VDD.

Figure 5:
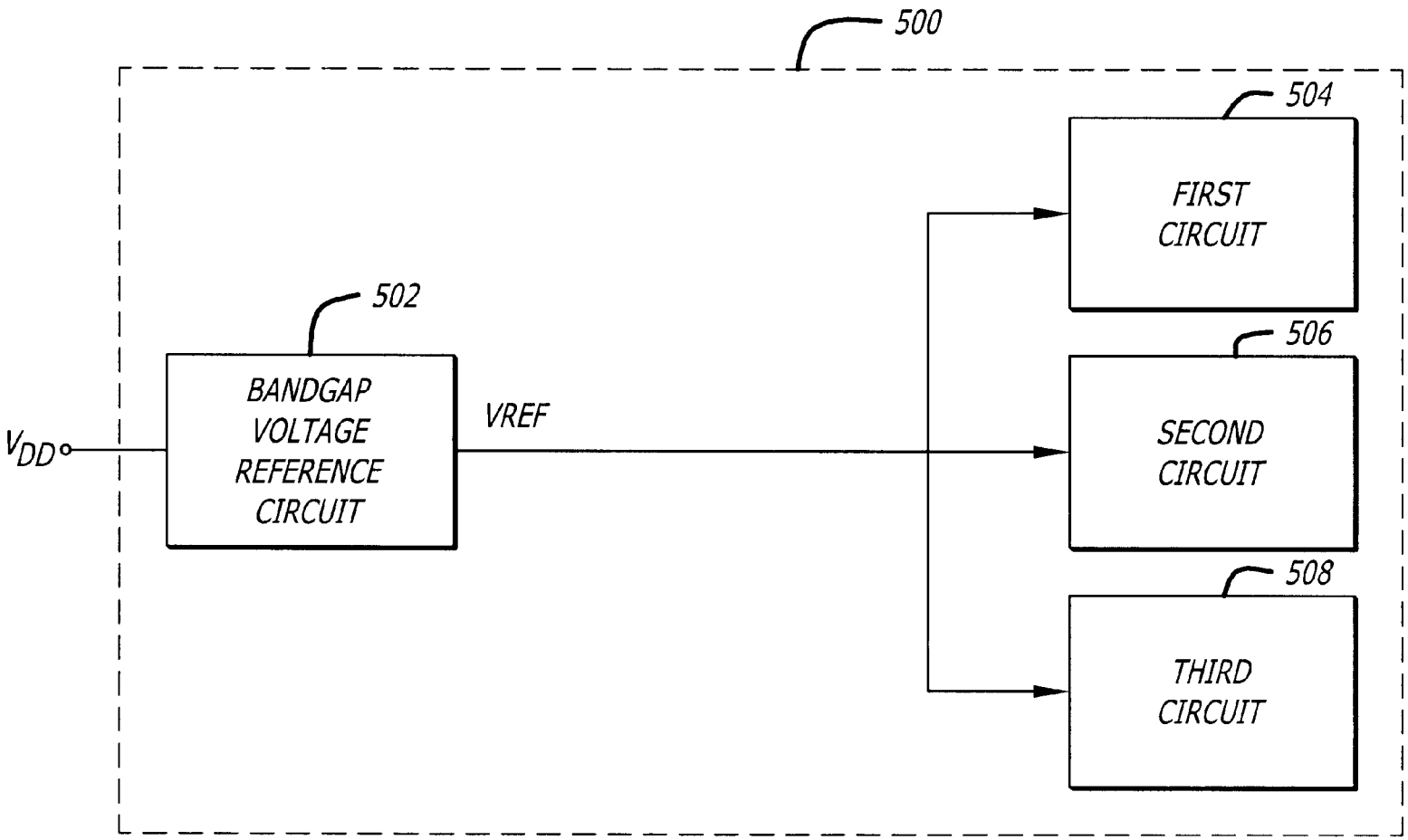
FIG. 5 illustrates a block diagram of an exemplary integrated circuit in accordance with another embodiment of the invention.

FIG. 5 illustrates a block diagram of an exemplary integrated circuit 500 in accordance with another embodiment of the invention. Generally, the bandgap reference voltage circuits 300 and 400 are used as part of an integrated circuit. Accordingly, integrated circuit 500 comprises a bandgap voltage reference circuit 502 such as bandgap circuit 300 or 400, and one or more circuits, such as illustrated first, second, and third circuits 504, 506 and 508, that use the reference voltage VREF generated by the bandgap circuit 502 in performing their intended operations. Although the bandgap circuit 502 is illustrated as part of integrated circuit 500, it shall be understood that the bandgap voltage reference circuit 502 could also be implemented as discrete components. In addition, the bandgap circuit 502 can also be implemented with NMOS, CMOS, bipolar, and other transistor technology.

In the foregoing specification, the invention has been described with reference to specific embodiments thereof It will, however, be evident that various modifications and changes may be made thereto without departing from the broader spirit and scope of the invention. The specification and drawings are, accordingly, to be regarded in an illustrative rather than a restrictive sense.

It is claimed:

1. A method comprising:

forming a first current having a first positive temperature coefficient, wherein forming said first current comprises:

forming a first voltage that has a second negative temperature coefficient;

forming a second voltage that has a third negative temperature coefficient that is more negative than said second negative temperature coefficient;

applying said first and second voltages on respective opposite sides of a second resistive element to form a fourth current through said resistive element that has a second positive temperature coefficient; and mirroring said fourth current to form said first current;

forming a second current having a first negative temperature coefficient, wherein forming said second current comprises:

applying said first voltage to a third resistive element to form a fifth current through said resistive element; and mirroring said fifth current to form said second current;

forming a third current being a combination of the first and second currents; and directing said third current to flow through a first resistive element to generate a reference voltage.

2. The method of claim 1, further comprising configuring said first positive temperature coefficient and said first negative temperature coefficient such that said third current is substantially invariant with changes in temperature.

3. The method of claim 1, wherein said reference voltage is substantially invariant with changes in temperature.

4. The method of claim 1, wherein said first resistive element comprises a resistor.

5. The method of claim 1, wherein said second resistive element comprises a resistor.

6. An apparatus, comprising:

a first current source to generate a first current that has a first positive temperature coefficient;

a second current source to generate a second current that has a first negative temperature coefficient, wherein said second current source comprises:

an operational amplifier having a negative input to receive a first voltage that has a second negative temperature coefficient;

a second resistive element coupled to a positive input of said operational amplifier to generate a fourth current from said first voltage; and a current mirror to generate said second current by mirroring said fourth current; and a first resistive element to receive a third current being a combination of said first and second currents to form a reference voltage.

7. The apparatus of claim 6, wherein said first and second positive temperature coefficients are selected to cause said third current to be substantially invariant with changes in temperature.

8. The apparatus of claim 6, wherein said reference voltage is substantially invariant with changes in temperature.

9. The apparatus of claim 6, wherein said first resistive element comprises a resistor.

10. The apparatus of claim 6, wherein said first current source comprises:

a current mirror to form third and fourth currents in addition to forming said first current, said first, third and fourth currents being substantially equal to each other;

a first diode to receive said third current to form a first voltage that has a second negative temperature coefficient;

a second resistive element coupled in series with a second diode to receive said fourth current, said fourth current developing a second voltage across said second diode that has a third negative temperature coefficient that is more negative than said second negative temperature coefficient; and a controlling device to control said current mirror to cause said first voltage and said second voltage to appear on respective opposite sides of said second resistive element.

11. The apparatus of claim 10, wherein said controlling device comprises an operational amplifier having a first input coupled to said first diode, a second input coupled to said second resistive element, and an output coupled to said current mirror.

12. The apparatus of claim 10, wherein said second resistive element comprises a resistor.

13. An integrated circuit, comprising:

a voltage reference source comprising:

a first current source to generate a first current that has a first positive temperature coefficient;

a second current source to generate a second current that has a first negative temperature coefficient, wherein said second current source comprises:

an operational amplifier having a negative input to receive a first voltage that has a second negative temperature coefficient;

a second resistive element coupled to a positive input of said operational amplifier to generate a fourth current from said first voltage; and a current mirror to generate said second current by mirroring said fourth current; and a first resistive element to receive a third current being a combination of said first and second currents to form a reference voltage; and one or more circuits that use said reference voltage to perform their respective operations.

14. The integrated circuit of claim 13, wherein said first and second positive temperature coefficients are selected to cause said third current to be substantially invariant with changes in temperature.

15. The integrated circuit of claim 13, wherein said reference voltage is substantially invariant with changes in temperature.

16. The integrated circuit of claim 13, wherein said first resistive element comprises a resistor.

17. The integrated circuit of claim 13, wherein said first current source comprises:

a current mirror to form third and fourth currents in addition to forming said first current, said first, third and fourth currents being substantially equal to each other;

a first diode to receive said third current to form a first voltage that has a second negative temperature coefficient;

a second resistive element coupled in series with a second diode to receive said fourth current, said fourth current developing a second voltage across said second diode that has a third negative temperature coefficient that is more negative than said second negative temperature coefficient; and a controlling device to control said current mirror to cause said first voltage and said second voltage to appear on respective opposite sides of said second resistive element.

18. The integrated circuit of claim 17, wherein said controlling device comprises an operational amplifier having a first input coupled to said first diode, a second input coupled to said second resistive element, and an output coupled to said current mirror.

19. The integrated circuit of claim 17, wherein said second resistive element comprises a resistor.

* * * * *